US006236831B1

(12) United States Patent
Mei et al.

(10) Patent No.: US 6,236,831 B1
(45) Date of Patent: May 22, 2001

(54) METHOD AND APPARATUS OF RECYCLING OFFICE PAPER

(75) Inventors: Ping Mei, Palo Alto; Jaan Noolandi, Mountain View; James B. Boyce, Los Altos, all of CA (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/342,867

(22) Filed: Jun. 29, 1999

(51) Int. Cl.[7] ..... G03G 15/00; G03G 21/00

(52) U.S. Cl. ..... 399/411; 15/102

(58) Field of Search ..... 399/1, 23, 390, 399/411; 347/1, 16, 101; 15/77, 102; 134/122 R, 122 P; 156/247, 281, 389; 162/4, 265

(56) References Cited

U.S. PATENT DOCUMENTS

| | | | | |
|---|---|---|---|---|
| 4,872,777 | | 10/1989 | Dalbke | 401/199 |
| 5,113,221 | | 5/1992 | Kotani et al. | 355/208 |
| 5,463,447 | * | 10/1995 | Kurotori et al. | 399/1 |
| 5,593,937 | * | 1/1997 | Saito et al. | 15/77 X |
| 5,612,766 | * | 3/1997 | Iida et al. | 399/23 |
| 5,632,856 | | 5/1997 | Buie | 162/4 |
| 5,920,743 | * | 7/1999 | Yamada et al. | 399/1 |
| 5,943,067 | * | 8/1999 | Kong | 347/101 |

OTHER PUBLICATIONS

Xeikon Website: http://www.globalprint.com/ipex98/24/xeikon1step.htm—Jun. 24, 1999.

* cited by examiner

*Primary Examiner*—Sophia S. Chen
*Assistant Examiner*—Hoan Tran
(74) *Attorney, Agent, or Firm*—Kent Chen

(57) ABSTRACT

A method and apparatus for recycling marking surfaces such as office paper is described. The system scans a marking surface, determines the location of printing on the marking surface and deposits erasing material directly over the printing. Because the distribution of erasing material is confined to the printed areas, the use of erasing material is minimized. The described system can be easily adapted for use in traditional copying systems to recycle paper.

21 Claims, 5 Drawing Sheets

METHOD AND APPARATUS OF RECYCLING OFFICE PAPER

FIELD OF THE INVENTION

The invention relates to a system and method for recycling office paper.

BACKGROUND OF THE INVENTION

Each year, businesses generate tons of waste including large amounts of used paper. A significant percentage of the used paper is recycled. Recycling reduces the amount of waste going into landfill and also saves natural resources used to manufacture new paper. Such savings can be significant, for example, one ton of high quality paper typically requires four tons of green wood.

Paper recycling traditionally occurs in large dedicated recycling facilities. The recycling facility receives used office paper from a general geographic area and processes the paper to create new sheets of paper. A traditional recycling facility includes large repulper machines which use mechanical action to break down paper into individual fibers. Wet chemical treatments are used to remove inks from the fibers. The resulting material is then reconstituted to form a low grade recycled paper.

Such methods of recycling paper are expensive and wasteful. One disadvantage of using centrally located recycling facilities is the personnel time and energy expenditures used to transport the used paper from a geographic region to the central recycling facility. A second disadvantage is the waste involved in exposing all the pulp to a bleaching agent when only a small percentage of the paper may be marked. A third disadvantage of present recycling systems is the low quality of the resulting recycled paper. Breaking down the sheet of paper and using the resulting paper pulp to reconstitute a recycled sheet of paper produces a low grade paper unsuitable for use in laser printers, and other office applications.

An alternative method of recycling paper uses solvents to soften and lift-off toner particles from the paper as described in U.S. Pat. No. 5,632,856 issued to Buie. The Buie reference describes a method of removing toner by pressing a preheated plastic film against a paper sheet. The toner fuses to the plastic ink film and is lifted from the paper sheet being recycled. The recycled sheet of paper is then rehumidified, calendarized and treated with toner to restore whiteness. The paper is also inspected to determine whether holes have been generated where the plastic has removed toner.

The method described in the Buie reference improves upon traditional recycling techniques but still suffers from the need to use expensive specialized equipment and is limited to recycling only paper marked with toners that can be removed using a preheated plastic film. Finally, the Buie method is harsh on the paper. Thus after the film is lifted off, the paper is rehumidified and inspected for possible holes generated where the plastic removed the toner.

Thus an improved method for recycling paper is needed.

SUMMARY OF THE INVENTION

A system to recycle paper is described. The system includes a scanner to scan a marking surface and determine the position of marks on the marking surface. The scanner communicates the position of the marks to a depositing apparatus which deposits an erasing material over the marks. In one embodiment of the invention, the erasing material is opaque and colored to match a background color of the paper. In an alternate embodiment, the marking material is a bleaching agent to remove or render transparent the marks on the paper.

BRIEF DESCRIPTION OF THE DRAWINGS

A more complete appreciation of the invention and many of the attendant advantages will be more readily obtained and understood by referring to the following detailed description and the accompanying drawings in which like reference numerals denote like elements as between the various drawings.

DETAILED DESCRIPTION

A method and apparatus to recycle office paper is described. In one embodiment of the invention, the sheet of paper to be recycled is scanned and an image of marks on the sheet is formed. The image of the marks may be formed on a xerographic photoreceptor in a process similar to that used in some light lens copiers produced by Xerox Corporation. A deposition or printing system deposits erasing material such as an opaque white toner or a bleaching compound over the marks. The erasing material may either remove the marks or conceal the marks behind the erasing material.

Figure 1A:
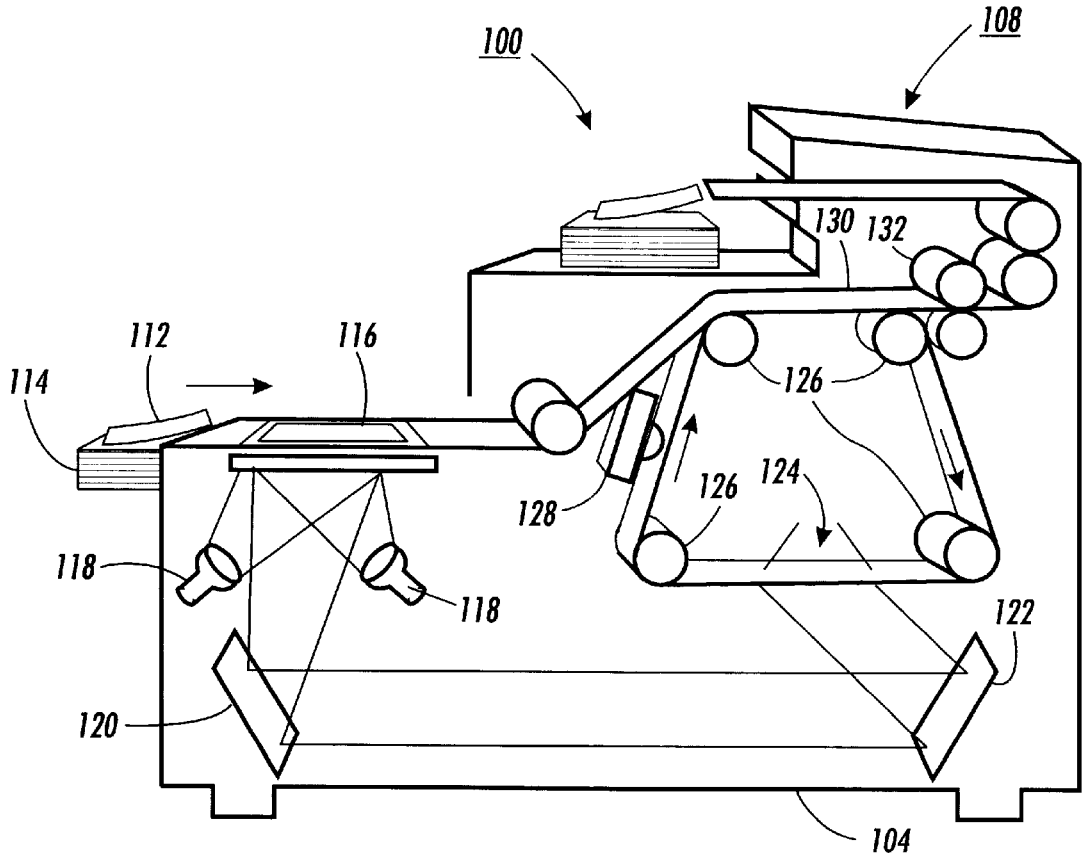
FIG. 1A illustrates a cross sectional diagram of a paper recycling machine as implemented in one embodiment of the present invention.

FIG. 1 illustrates one embodiment of a recycling apparatus 100. Recycling apparatus 100 includes a scanning device 104 that scans marks on a marking surface such as a sheet of paper to be recycled and records an image of the marks. As used in this application, scanning is defined as the process of determining the position, shape and orientation of marks which have been printed or deposited on a marking surface. Typically, the output of a scanning operation is an image, either electronic or printed, of the mark. Marks are defined as changes in color on the sheet of paper, typically caused by ink, toner or other print substances. Although some marks, such as letters in a text, have a predictable pattern, marks do not necessarily have a predictable pattern and may include images, typically non-textual images, that have arbitrary shapes and orientations. After scanning, the sheet of paper moves along a paper path to a printing or deposition apparatus 108. Printing apparatus 108 deposits an erasing material over the marks. The erasing material may remove the marks from the sheet of paper or may conceal the marks with a "concealer", typically a colored opaque fluid or powder. When a concealer is selected, the color of the concealer is selected to match a background color of the sheet of paper.

In recycling apparatus 100, a paper handler moves a used sheet of paper 112 to be recycled from a stack 114 of paper to be recycled. The sheet of paper 112 is moved to an input of scanner device 104. In FIG. 1, the input to scanner device 104 is a transparent exposure window 116 which forms a flatbed similar to the scanning section of a traditional photocopy machine.

A light source such as exposure lights 118 illuminates the sheet of paper for scanning. Optical instruments such as mirrors 120, 122 transfer or communicate an image of the marks on the sheet from exposure window 116 to a memory or recording device. In the illustrated embodiment, the recording device is an exposure surface 124 made from photo-receptors which are light sensitive. The photo-receptors generate charge as a function of the light intensity received to create a charged exposure surface 124 that matches the image of marks on the sheet of paper 112.

A printing or depositing apparatus uses the image stored in the recording or memory device such as the charged exposure surface 124 to distribute erasing material. In FIG. 1, marking apparatus 108 includes a system for moving the charged exposure surface along a belt system including rollers 126. The rollers guide charged exposure surface 124 through an eraser toner cartridge 128 containing an erasing material such as an erasing toner. The erasing toner cartridge 128 distributes toner across the charged exposure surface 124 in a pattern that matches the distribution of marks on the sheet of recycled paper. In a transfer region 130, the sheet of paper and the charged exposure surface are brought in contact to transfer the erasing material to the sheet of paper to be recycled.

The erasing material may be made from substances which either remove the marks (bleaching agents) on the used paper or conceal the marks (concealing agents) behind an opaque media colored to match a background color of the paper to be recycled. The erasing material may be a fluid as is typically used in an inkjet or other ink droplet delivery system or a dry particulate as used in a laser printer type system. In the illustrated embodiment of FIG. 1, the erasing material is an opaque colored toner for use in a xerographic print engine. The color of the toner is selected to match a background color of the sheet of paper to be recycled. As used in this application, the background color of a sheet of paper is defined as the color of the paper in its original state (before the sheet of paper was used). Typically, the background color remains the dominant color, the color of over 50% of the sheet of paper. The most common background color is white. As used herein, the color "white" is defined to be the color of commercially available office paper that is labeled and sold as "white" office paper such as that offered by Xerox Corporation of Stanford Conn. Other common background colors include ivory and beige.

After the erasing toner is transferred to the sheet of paper, the toner is fused to the paper. To fuse the toner to the paper, fixing rollers 132 may be used to apply heat to the toner and paper. When the erasing toner is an opaque colored ink, the ink bonds to and conceals the mark on the sheet of paper. In alternate embodiments, the erasing toner may be made with a chemically reactive substance which chemically bleaches the mark at the high temperatures used in the fusing process.

Figure 1B:
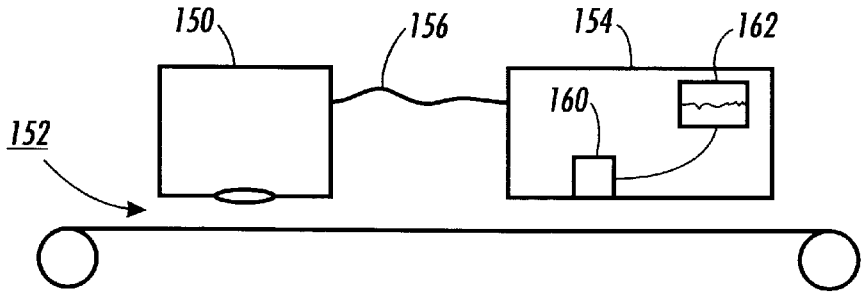
FIG. 1B illustrates an alternate embodiment of the invention which uses inkjets as a depositing apparatus.

FIG. 1B illustrates an alternative embodiment of the invention that implements the depositing apparatus using inkjets. In FIG. 1B, scanner 150 images the paper propagating along paper path 152. The position, shape, and orientation of arbitrarily positioned marks is communicated from scanner 150 to a depositing apparatus 154 along signal path 156. Signal path 156 may be an electrical or optical signal path.

In the illustrated embodiment, depositing apparatus 154 includes an inkjet print head 160. The inkjet print head retrieves erasing material in fluid form from an erasing material reservoir 162. The inkjet print head ejects droplets of erasing material in a pattern that approximately matches the images detected by scanner 150. The inkjet print head may cause the ejection of droplets using a variety of technologies known to those of skill in the art. These technologies include heating the material to be ejected as described in U.S. Pat. No. 5,851,412 entitled "Thermal Ink-jet Printhead with a Suspended Heating Element in each Ejector" or subjecting the material to be ejected to acoustic waves as described in U.S. Pat. No. 5,565,113 entitled "Lithographically Defined Ejection Units". Both patents are assigned to Xerox Corporation and are hereby incorporated by reference.

A third emboident of the invention uses an architecture substantially the same as that shown in FIG. 1B except that the inkjet print head 160 is replaced with a laser and a toner deposition system. A system that uses a laser to direct the depositing of erasing material in a laser printer is described in U.S. Pat. No. 5,229,790 entitled "Laser Printer with Parameter Switching in Accordance with Scanning Density." U.S. Pat. No. 5,229,790 describes the operation of a typical laser printer and is hereby incorporated by reference.

In fact, virtually any known method for imparting a mark to a surface may be employed by the present invention as will be apparent to one of ordinary skill in the art.

Figure 2:
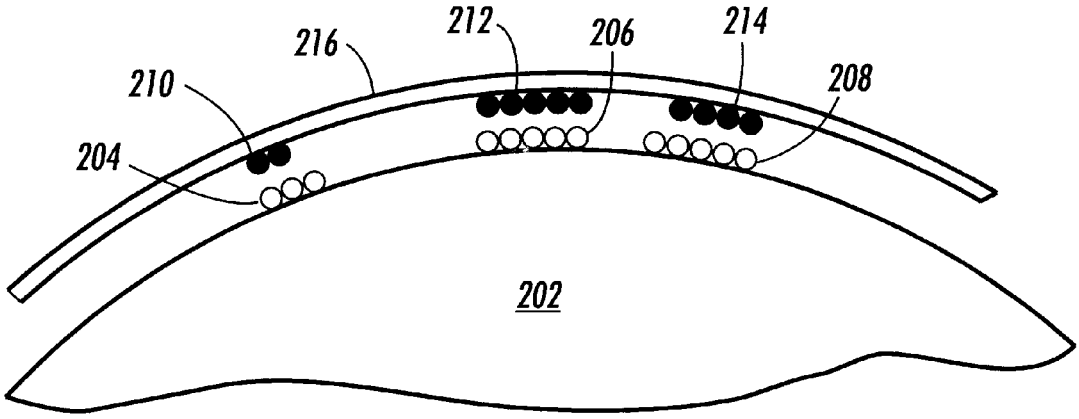
FIG. 2 illustrates a magnified view of depositing an erasing material to cover marks on a sheet of paper.

FIG. 2 illustrates the deposition of erasing material on the used sheet of paper according to one embodiment of the invention. In the illustrated embodiment, a photoconductor drum 202 deposits erasing toner 204, 206, 208 over marks 210, 212, 214 on the sheet of used paper 216. The distribution of eraser toner 204, 206, 208 approximately matches the coverage area of marks 210, 212, 214.

Exact alignment of marks 210, 212, 214 with the eraser toner 204, 206, 208 is difficult. Vibrations, paper slippage and other artifacts may cause the paper to be slightly misaligned with the element distributing the eraser material such as a photoconductor drum. To provide tolerances for slight misalignments, the area covered by eraser toner 204, 206, 208 is set slightly larger than the area of the corresponding mark being concealed to assure complete coverage of marks 210, 212, 214. One method of making the eraser toner spot larger than the corresponding mark being concealed is to slightly defocus the lenses which generate and form an image during scanning of the marks. A slightly defocussed or blurred image on the photoconductor exposure surface causes areas closely surrounding the mark to also receive erasing material. Alternatively, digital systems may use a processor to adjust erasing material coverage to increase the area coverage of the erasing material.

Figure 3:
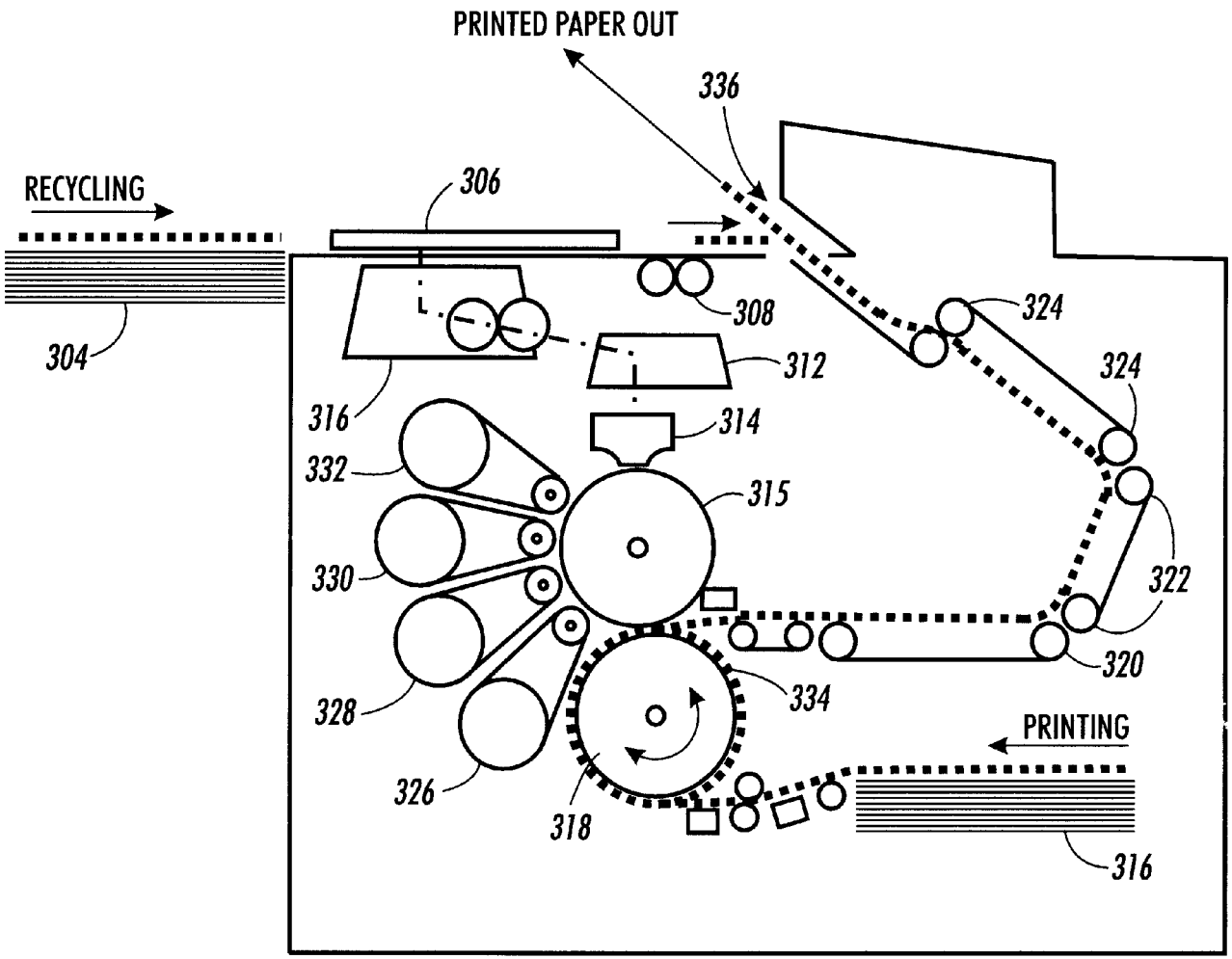
FIG. 3 illustrates implementing one embodiment of a recycling system in a photocopy machine.

Many components used in the recycling apparatus of FIG. 1 are also used in a traditional photocopy machine. Thus a traditional photocopy machine may be modified to include a recycle function. FIG. 3 illustrates a traditional color photocopy machine modified to also recycle sheets of paper. In FIG. 3, a paper handler moves a used sheet of paper to be recycled from a source of used paper 304 to exposure window 306. Light from exposure lamps 308 illuminate the used paper through a transparent surface such as a glass surface of exposure window 306. Reflected light forms an image of the marks. The image is transmitted along an optical path which includes filters 310, mirrors 312 and lenses 314. Because the photocopier may be used for both exactly copying an image and recycling a sheet, the optical path may be adjusted between a recycle mode and a photocopy mode. In a photocopy mode, an exact image of the marks on the used paper is generated. In a recycle mode, a slightly defocused image may be generated to slightly "spread" an image of each mark.

A memory or recording mechanism stores an image of the mark while the used sheet of paper moves from being scanned to a "printing" location where erasing material is deposited. In the system of FIG. 3, the photoconductor drum 315 serves as the memory device by arranging charge patterns to match the image of the marks on the drum surface. In digital systems, a semiconductor memory such as a random access memory (RAM) may be used to store a digitized image of the marks on the used sheet of paper while the used sheet of paper is moved from a scanning to a printing location.

After an image of the marks on the used sheet are recorded, paper handlers transfer the used sheet of paper from the exposure window 306 to a printing paper path. The printing paper path guides the movement of paper through the photocopier during the placement of ink, toner, or erasing material. In FIG. 3, the printing path includes transfer roller 318 and other paper handler mechanisms such as roller and belt systems 320, 322, 324. To simplify systems within photocopier 300, the same printer paper path may be used to perform print operations when photocopying on new paper from new paper supply 316 as when depositing erasing material on a used sheet of paper.

To convert the charged image patterns into a distribution of toner, developer units 326, 328, 330, 332 cover charged portions of the photoconductor drum with a corresponding toner. In the illustrated example, developer unit 326 contains cyan colored toner, developer unit 328 contains yellow toner, developer unit 330 contains magenta colored toner and developer unit 332 contains erasing material. For purposes of illustration, the erasing material will be described as white colored toner. Additional developer units for use in a recycling mode may contain other erasing material, such as ivory colored toner to match ivory colored paper or bleaching agents to remove or fade marking materials such as toner or ink. When used in a photocopy mode, the photocopier selects developer units containing a toner closest in color to the color of the mark being duplicated. The selected developer unit, typically a developer unit containing black toner for standard photocopying and printing applications, deposits toner in charged regions corresponding to the marks being duplicated.

When in a recycle mode, photocopier 300 selects a developer unit 332, which contains erasing material. Automatic selection of developer unit 332 may occur when a recycle function is selected on the photocopier. When different erasing capabilities are desired for handling different types of paper or different types of marks, several developer units, each containing a different eraser material may be implemented. Selection of the appropriate developer unit may be manually or automatically switched. One example of a use for different developing units is to accommodate different types of "concealer" erasing material, each concealer for use with a different background color of paper. Automatic selection of concealer may be achieved by including in the scanner circuitry a sensor which determines the background color of the sheet of paper to be recycled, typically the color of over 50% of the sheet. Control circuitry then selects the output color of the toner from the developing units to match the background color of the sheet of paper.

After each developing unit 326, 328, 330, 332, deposits the appropriate eraser toner on photoconductor drum 315, the drum rotates and contacts at a contact point the used paper to be recycled. FIG. 2 shows an enlargement of the contact point and the distribution of eraser toner with respect to the mark. After the erasing material is deposited over each mark, the recycled paper appears as a single uniform color across the entire sheet. Paper handlers transport the recycled paper along the output paper path to a printed paper output port 336.

After being output from photocopier 300, the recycled paper may be repositioned adjacent to new paper supply 316 for re-input into a print section of the photocopier. When a new document to be photocopied is placed on exposure window 306, photoconductor drum 315 receives toner distributed to form an image of the pattern on the new document and transfers the toner to the recycled paper. Thus, in some regions of the recycled paper, the toner may be three layers thick including the toner from an original image, an eraser toner concealing the original image, and a new image generated by toner superimposed on the eraser toner. After the recycled sheet receives the imprint of an image from photoconductor drum 315, the recycled paper with the new image is output from photocopier output 336.

Figure 4:
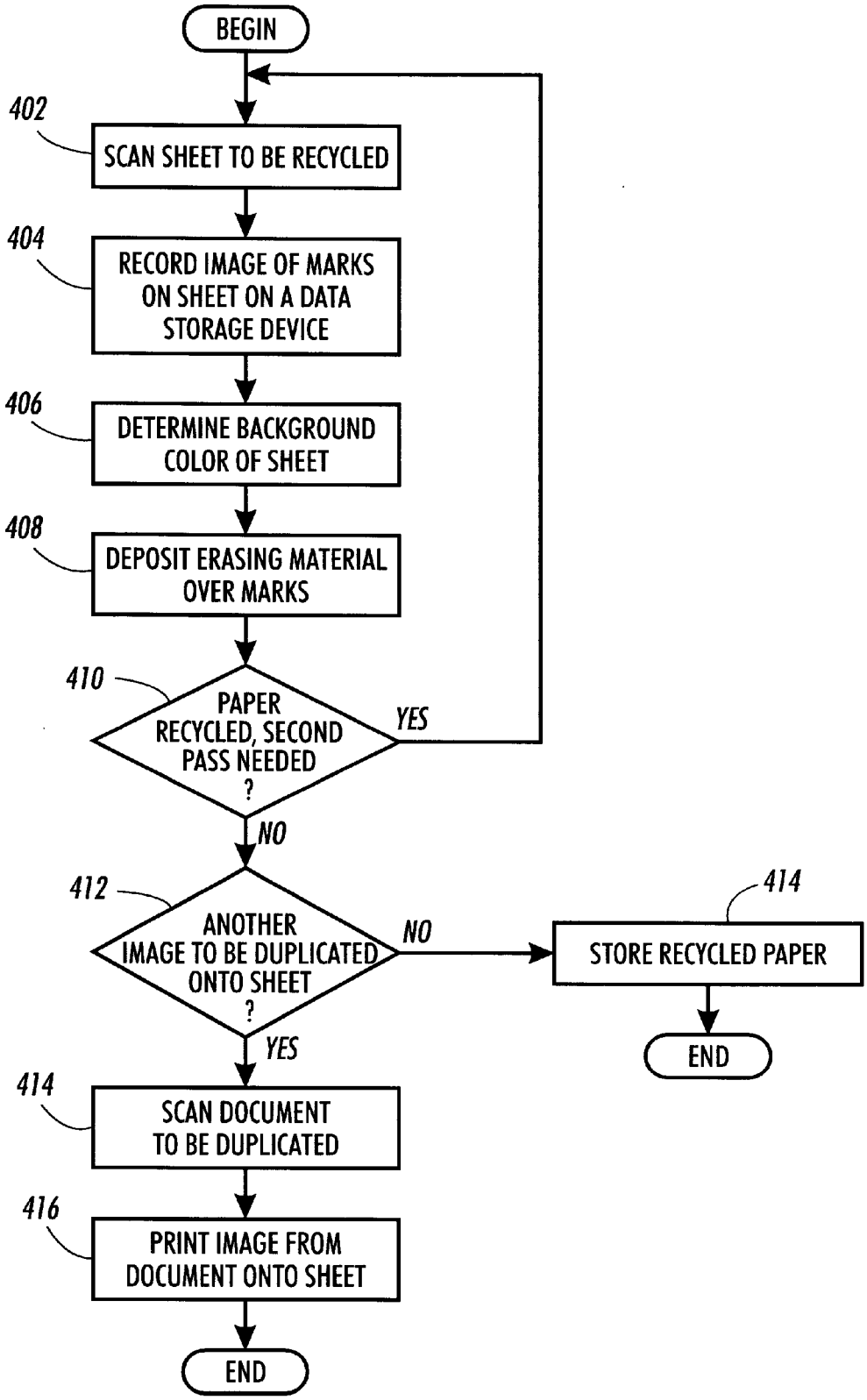
FIG. 4 shows a flow diagram of the procedures used in the recycle process.

FIG. 4 shows a flow diagram 400 illustrating the operations used in one embodiment of the invention. In block 402, a scanner scans the sheet of paper to be recycled. The scanner determines the distribution or pattern of marks on the sheet of paper. The marks may include both text and/or images. Although typically black in color, the marks may be any color other than the background color of the paper.

The scanner then transmits the pattern of marks to a storage device where the pattern is recorded in block 404. Temporary storage of the pattern of marks allows the sheet of paper to be moved from a scanning section of the device to an eraser material depositing or printing section. The storage device may be as simple as a photoconductor drum which stores the pattern of marks as a charge distribution on a surface of the drum. Other storage techniques are also available to one skilled in the art. For example, in digital systems, a random access memory (RAM) may be used to store a digital representation of the pattern of marks.

In one embodiment of the invention, the background color of the sheet of paper is determined as shown in block 406. In a second embodiment of the invention the background color of the sheet is unimportant. For example, when the erasing material removes or lifts ink or toner from the sheet of paper, the background color of the paper is irrelevant and does not need to be determined. A third embodiment of the invention assumes that the background color of the paper is white and does not determine the background color of the sheet.

In embodiments of the invention which recycle colored paper and which use a concealing technique that obscures or conceals marks instead of removes the mark, the background color of the paper may be important. In such embodiments, the color of the concealing material is selected to match the background color of the sheet. Such selection may be achieved manually using switches on the recycling device. Alternately, such selection may be achieved automatically by scanning the sheet of paper, determining a dominant (over 50%) color on the sheet of paper, and assigning the dominant color as the background color.

In block 408, erasing material is deposited over the marks. The coverage area of the erasing material over the sheet of paper is minimized while still assuring coverage over the marks. Due to slight errors in aligning the sheet of paper and variations within a tolerance in the placement of erasing material, the erasing material covers a slightly larger area than the marks on the sheet of paper as illustrated in FIG. 2. This assures that there is complete coverage of the marks.

However, in order to save erasing material, and also minimize damage to the paper, coverage is minimized such that on average, less than 10% of unmarked areas of the sheet are exposed to erasing material. The actual percentage of unmarked areas covered by erasing materials depends on a number of factors including the necessary tolerances for ink placement and whether marks on the sheet have a significant number of edges. Marks which cover a small area but have long edges or circumferences result in a larger percentage of unmarked area being exposed to erasing material.

In block 410, a scanner may be used to re-scan the recycled paper to determine if all marks have been removed. When color variations across a sheet of paper exceed a threshold level, the system signals that marks are still detectable on the sheet of paper, and the recycling system returns to block 402 to remove or conceal the remaining marks. When in block 410, the scanner determines that all marks on the sheet of paper are below a predetermined threshold and thus are no longer visually detectable, the system considers the sheet of paper to be completely recycled.

In block 412, the system determines whether an image is to be printed on the completely recycled sheet of paper. If no image is to be immediately printed, the recycled paper is stored for future use as illustrated in block 414. When the recycling system is implemented in a photocopy machine, the photocopy machine may allow a user to select printing on either recycled paper or new paper. For most purposes, the recycled paper may be almost equivalent to new paper. However, for certain presentations, it may be important to have new paper. A switch on the photocopier may allow a user to select between the types of paper. The switch may be implemented as hardware or software. A software switch could select paper types based on instructions from a connected computer or alternately, the software switch could use parameters detected in the scanned paper, for example graph lines, to select paper types. In certain applications such as networked systems, less important tasks, such as the printout identifying a user may be set to print on recycled paper.

When it is acceptable to use recycled paper for an application, the document to be duplicated or photocopied is scanned in block 414. The recycling system prints an image of the document onto the recycled paper in block 416. Such printing systems to print an image are well known in the art and may include xerographic systems, inked ribbon systems, and ink jet or other droplet delivery systems. In xerographic systems that recycle paper using an opaque concealing toner, the final printed product may include three layers of toner, a first toner layer defining a mark, the second toner layer representing a concealing toner, and the third layer of toner defining the final print. Likewise, when ink jets are used, three layers of ink may result.

The previous description has described a system which recycles an entire sheet of paper. However, to further save erasing material, "smart" embodiments of the invention may compare the marks on the sheet of paper to be recycled and an image to be rendered on the sheet of paper and only remove marks from the portions necessary. The technique is illustrated using black toner to create marks and white toner to erase marks as shown in FIG. 5.

Figure 5:
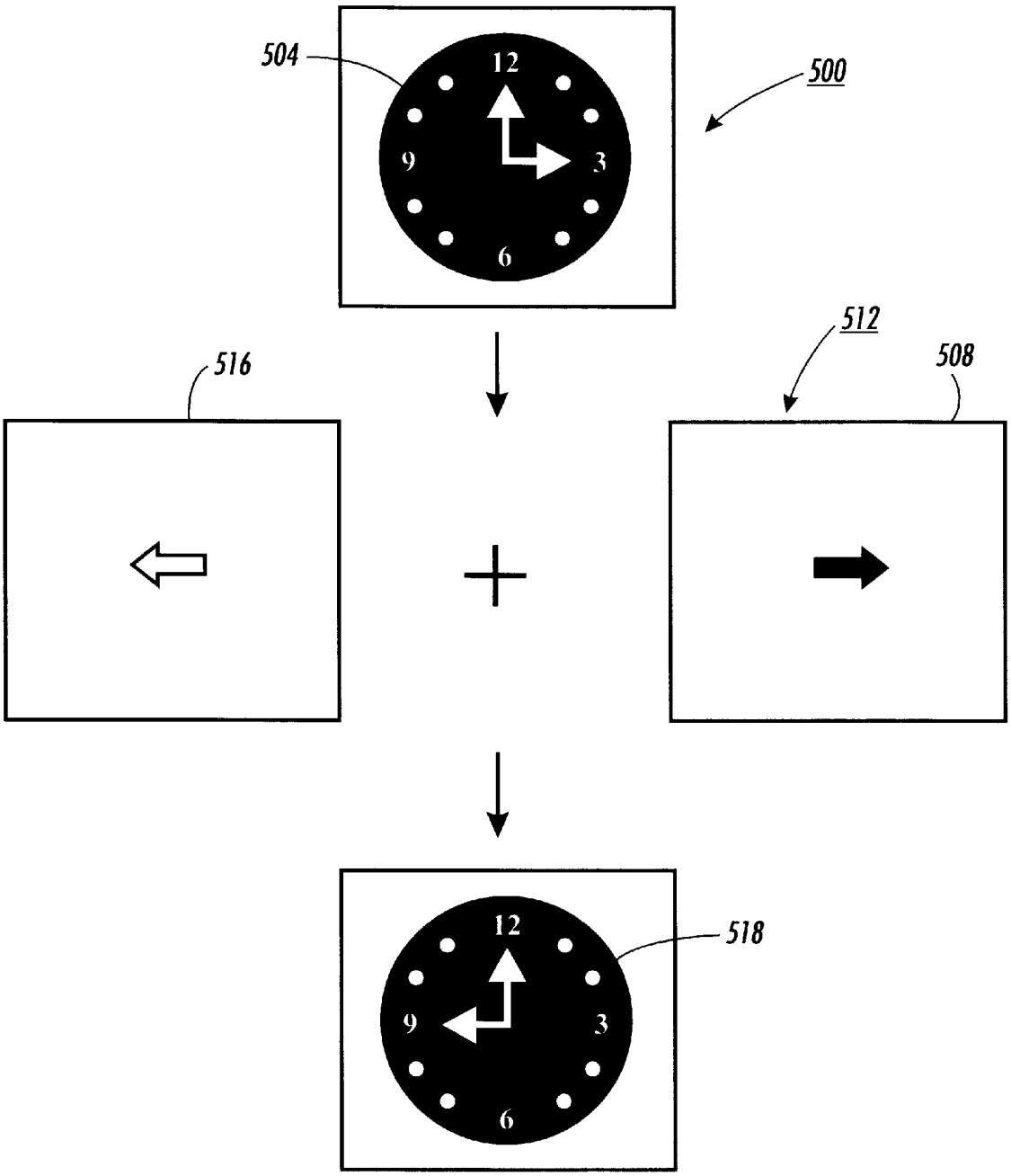
FIG. 5 illustrates the placement of eraser material and marking toner to generate a second image.

In FIG. 5, an original pattern of markings 504 exists on a sheet to be recycled 500. The sheet to be recycled is scanned and stored in a memory or storage device. A second image 508 which is to be printed on the sheet to be recycled 500 is also scanned. A processor in the recycling device compares the scan of the existing pattern of markings 504 with a scan of the second image 508 and determines what coordinates or positions of the image experience a change in marking color.

In the example shown in FIG. 5, a processor determines where black toner is needed as shown in composite 512 and where white toner is need as shown in composite 516. By placing white toner only where there is a change from black to white and black toner only where there is a change from white to black, the recycling system recycles the paper with minimal use of both white and black toner. The system may also operate more quickly than previously described recycling systems because only one pass of the recycled paper through the printer section is needed provided the system can place both white and black toner simultaneously. The disadvantage of the system is the increased cost from the processor used to perform the comparison operations.

An alternate use of the system of FIG. 5 is to use the erasing material as a "masking layer" to conceal data underneath the erasing material. For example, if the original printed layer was printed with a magnetic ink, the erasing material could allow the printed material to be visually erased to prevent an observer from viewing the printed image. A second image or graphic could be printed over the erasing material to create a desired visual image. However, a magnetic reader would still be able to detect the original underlying image.

While the preceding invention has been described in terms of a number of specific embodiments, it will be evident to those skilled in the art that many alternatives, modifications, and variations are within the scope of the teachings contained herein. For example, although the preceding description describes using inkjets or laser deposition techniques on paper, the invention is also applicable to silkscreening, and painting devices which deposit marking substances on a wide variety of media. Accordingly, the present invention should not be limited by the embodiments used to exemplify it, but rather should be considered to be within the spirit and scope of the following claims and its equivalents, including all such alternatives, modifications, and variations.

What is claimed is:

1. A method of recycling a marking surface comprising:

causing an apparatus to scan the marking surface to detect at least one mark and determine the position of the at least one mark;

communicating the position to a depositing apparatus; and causing the depositing apparatus to deposit a concealing material on the marking surface over the at least one mark, the concealing material selected to match a background color of the marking surface and thereby conceal the at least one mark.

2. The method of claim 1 further comprising:

depositing a second marking material on the marking surface, a color of the second marking material selected to be different from the background color of the marking surface.

3. The method of claim 2 wherein the marking material is superimposed over the concealing material.

4. The method of claim 2 further comprising:

scanning a document including an image and directing the depositing of the marking material on the marking surface to match the image.

5. The method of claim 1 further comprising:

scanning a second pattern;

determining differences between the second pattern and a first pattern including the at least one mark on the marking surface; and depositing the concealing material and a second marking material on the marking surface to erase the first pattern and to generate the second pattern.

6. The method of claim 1 wherein the concealing material is a toner and the depositing of the concealing material further includes the operations of:

using a laser to define the depositing of the toner over the at least one mark.

7. The method of claim 1 wherein the depositing apparatus is an ink jet printer that outputs the concealing material in a fluid form.

8. The method of claim 1 further comprising:

storing the position of the at least one mark; and moving the marking surface from a scanning position to a printing position for the depositing of the concealing material.

9. The method of claim 1 wherein the scanning of the marking surface includes the operations of:

irradiating the marking surface with light; and using an array of sensors to determine the position of the at least one mark on the marking surface.

10. The method of claim 1 wherein the marking surface is a sheet of paper.

11. The method of claim 1 wherein the at least one mark is nontextual mark and the scanning apparatus determines a shape, orientation and position of the at least one mark and communicates the shape, orientation and position to the at least one mark to the depositing apparatus.

12. An apparatus to recycle a sheet of paper comprising:

a scanning device to determine the position of at least one mark on a marking surface; and concealing material depositing apparatus to deposit a concealing material over the at least one mark, the color of the concealing material selected to match a background color of the marking surface.

13. The apparatus of claim 12 wherein the total area covered by the concealing material is between 100% and 110% of the area covered by the at least one mark.

14. The apparatus of claim 12 wherein the concealing material is a powdered toner.

15. The apparatus of claim 14 wherein the powdered toner is a white toner.

16. The apparatus of claim 12 further comprising:

a handler to direct the marking surface with the at least one mark concealed by the concealing material to a loading position for printing with a marking material, a color of the marking material is different from a background color of the marking surface.

17. The apparatus of claim 12 wherein the concealing material and the color of the background of the marking surface are both white.

18. A copy machine including a recycle feature to recycle a marking surface comprising:

a switch to select between a copying and a recycling mode;

a scanner to detect an image on the marking surface;

a handler to move the marking surface to a print section; and a print section of the copy machine to print the image on the marking surface with an erasing material selected to match a background color of the marking surface when the switch is set to select the recycling mode.

19. The copy machine of claim 18 further comprising:

a plurality of toner cartridges, each toner cartridge to store a corresponding erasing material; and a toner selector, the toner selector to select a toner cartridge for storing a corresponding erasing material with the color matching the background color of the marking surface when the copy machine is in the recycling mode, the toner selector to select a color of toner that does not match the background color of the marking surface when the copy machine is in the nonrecycling or copying mode.

20. The copy machine of claim 18 wherein the scanner includes a sensor to determine the background color of the marking surface.

21. The copy machine of claim 18 wherein the handler repositions the marking surface to the print section to print a second scanned image with a second toner, the second toner having a color different from the background color of the marking surface.

* * * * *